US007424934B2

(12) United States Patent
Husmann et al.

(10) Patent No.: US 7,424,934 B2
(45) Date of Patent: Sep. 16, 2008

(54) METHOD FOR VIBRATION DAMPING AT AN ELEVATOR CAR

(75) Inventors: Josef Husmann, Luzern (CH); Hans Musch, Zürich (CH)

(73) Assignee: Inventio AG, Hergiswil NW (CH)

( * ) Notice: Subject to any disclaimer, the term of this patent is extended or adjusted under 35 U.S.C. 154(b) by 640 days.

(21) Appl. No.: 11/049,005

(22) Filed: Feb. 2, 2005

(65) Prior Publication Data

US 2005/0167204 A1 Aug. 4, 2005

(30) Foreign Application Priority Data

Feb. 2, 2004 (EP) ..... 04405064

(51) Int. Cl.
*B66B 1/34* (2006.01)

(52) U.S. Cl. ..... 187/292; 187/393

(58) Field of Classification Search ..... 187/292, 187/393, 394, 409, 410; 318/609, 610, 611, 318/623; 361/143, 152
See application file for complete search history.

(56) References Cited

U.S. PATENT DOCUMENTS 5,289,902 A 3/1994 Fujita
5,304,751 A 4/1994 Skalski et al.
5,321,217 A 6/1994 Traktovenko et al.
5,597,988 A 1/1997 Skalski
5,652,414 A * 7/1997 Roberts et al. ..... 187/292
5,814,774 A * 9/1998 Remmers et al. ..... 187/292
6,494,295 B2 * 12/2002 Grundmann ..... 187/292

FOREIGN PATENT DOCUMENTS

EP 0 641 735 3/1995
EP 0 731 051 9/1996
JP 2003089487 3/2003

OTHER PUBLICATIONS

Marra, M.A. et al., "Vibration Control for Machining Using H Techniques", Mar. 26, 1995, pp. 426-432, Raleigh, NC Proceedings of Southeastcon IEEE.

* cited by examiner

*Primary Examiner*—Jonathan Salata
(74) *Attorney, Agent, or Firm*—Fraser Clemens Martin & Miller LLC; William J. Clemens

(57) ABSTRACT

A method for designing a regulator uses a predetermined overall model of an elevator car with known structure. The model parameters are known to greater or lesser extent or estimations are present, wherein the parameters for the elevator car used are to be identified. In that case the frequency responses of the model are compared with the measured frequency responses. With the help of an algorithm for optimization of functions with numerous variables the estimated model parameters are changed to achieve the greatest possible agreement. The model with the identified parameters forms the basis for design of an optimum regulator for active vibration damping at the elevator car.

12 Claims, 5 Drawing Sheets

METHOD FOR VIBRATION DAMPING AT AN ELEVATOR CAR

BACKGROUND OF THE INVENTION

The present invention relates to a method for the design of a regulator for vibration damping at an elevator car, wherein the regulator design is based on a model of the elevator car.

Equipment and a method for vibration damping at an elevator car is shown in the European patent specification EP 0 731 051 B1. Vibrations or acceleration rising transversely to the direction of travel are reduced by a rapid regulation so that they are no longer perceptible in the elevator car. Inertia sensors are arranged at the car frame for detection of measurement values. Moreover, a slower position regulator automatically guides the elevator car into a center position in the case of a one-sided skewed position relative to the guide rails, wherein position sensors supply the measurement values to position regulators.

The equipment concerns a multivariable regulator for reducing the vibrations or accelerations at the elevator car and further multivariable regulator for maintenance of the play at the guide rollers or the upright position of the elevator car. The setting signals of the two regulators are summated and control a respective actuator for roller guidance and for horizontal direction.

The regulator design is based on a model of the elevator car, which takes into consideration the significant structural resonances.

It is disadvantageous that the overall model has a tendency to a high degree of complexity, notwithstanding refined methods for reduction in the number of poles. As a consequence thereof the model-based regulator is equally complex.

SUMMARY OF THE INVENTION

The present invention avoids the disadvantages of the known method and provides a simple method for the design of a regulator.

Advantageously, in the case of the method according to the present invention an overall model of the elevator car with known structure is predetermined. There is concerned in that case a so-termed multi-body system (MBS) model which comprises several rigid bodies. The MBS model describes the essential elastic structure of the elevator car with the guide rollers and the actuators as well as the force coupling with the guide rails. The model parameters are known to greater or lesser extent or estimates are present, wherein the parameters for the elevator car which is used are to be identified or determined. In that case the transfer functions or frequency responses of the model are compared with the measured transfer functions with several variables the estimated model parameters are changed in order to achieve a greatest possible agreement.

Moreover, it is advantageous that the active vibration damping system of the elevator car is itself usable for the transfer functions or frequency responses to be measured. The elevator car is excited by the actuators and the responses are measured by the acceleration sensors or by the position sensors.

This model-based design method of the regulator guarantees the best possible active vibration damping for the individual elevator cars with very different parameters.

It is ensured by the above-mentioned identification method that as a result the simplest and most consistent model of the elevator car is present. Advantageously the regulator based on this model has a better grade or a better regulating quality.

Moreover, the method can be systematically described and can be largely automated and performed in substantially shorter time.

Based on the MBS model with identified parameters a robust multivariable regulator is designed for reduction in the acceleration and a position regulator for maintenance of play at the guide rollers.

The acceleration regulator has the behavior of a bandpass filter and the best effect in a middle frequency range of approximately 1 Hz to 4 Hz. Below and above this frequency band the amplification and thus the efficiency of the acceleration regulator are reduced.

In the low frequency range the effect of the acceleration regulator is limited by the available play at the guide rollers and the position regulators to be designed thereof. The position regulator has the effect that the elevator car follows a mean value of the rail profiles, whilst the acceleration regulator causes a rectilinear movement. This conflict of objectives is solved in that the two regulators are effective in different frequency ranges. The amplification of the position regulator is large in the case of low frequencies and then decreases. This means that it has the characteristic of a low-pass filter. Conversely, the acceleration regulator has a small amplification at low frequencies.

In the high frequency range the effect of the acceleration regulator is limited by the elasticity of the elevator car. The first structural resonance can occur at, for example, 12 Hz, wherein this value is strongly dependent on the mode of construction of the elevator car and can lie significantly lower. Above the first structural resonance the regulator can no longer reduce the acceleration at the car body. The risk even exists that structural resonances are excited or that instability can arise. With knowledge of the dynamic system model of the regulator path the regulator can be so designed that this can be avoided.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The MBS model has to reproduce the significant characteristics of the elevator car with respect to travel comfort. Since in the case of identification of the parameters it is possible to operate only with linear models, all non-linear effects have to be disregarded. The first natural frequencies of the elastic elevator car are so low that they can overlap with the so-termed solid body natural frequencies of the entire car.

Figure 1:
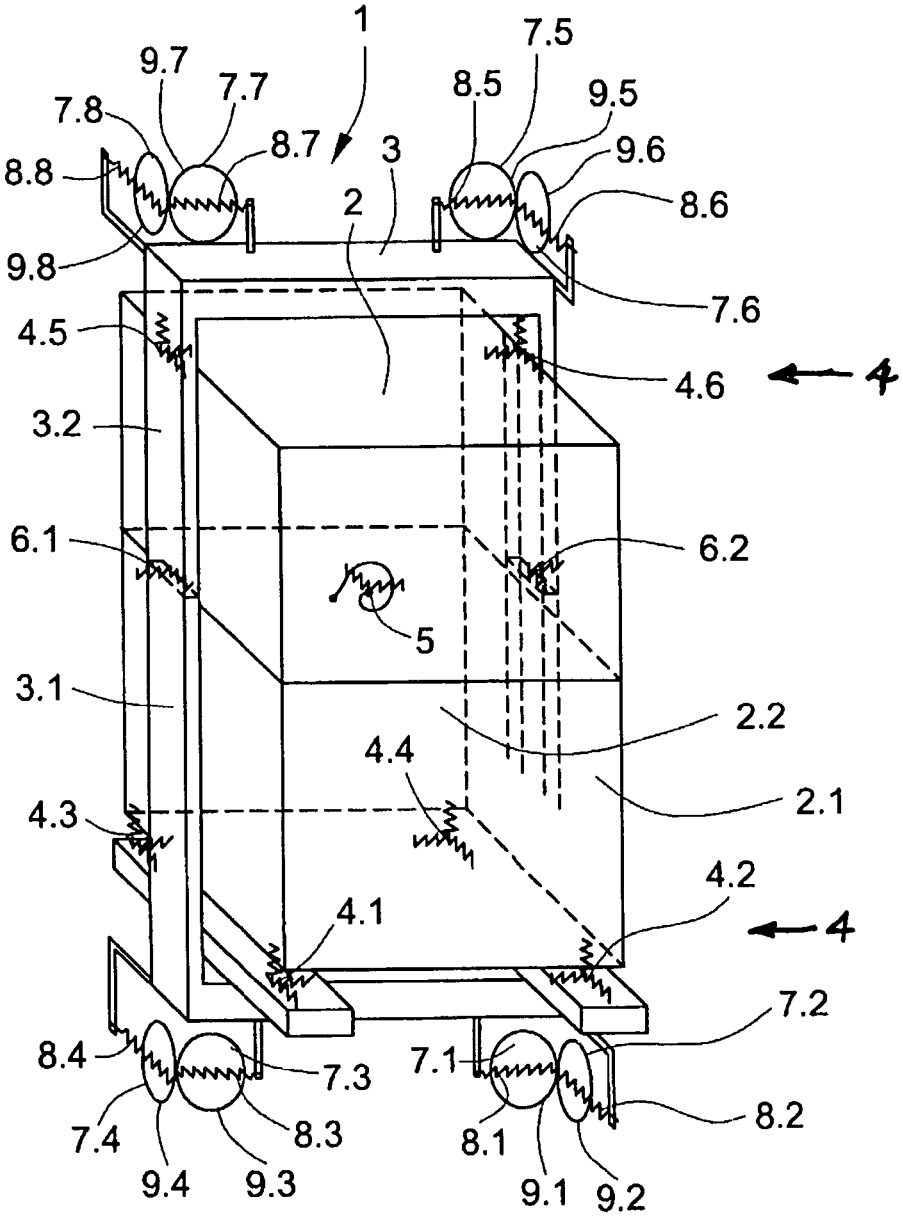
FIG. 1 is a schematic perspective view of a multi-body system (MBS) model of an elevator car in accordance with the present invention.

As shown in FIG. 1, at least two rigid bodies are required for modeling an elastic elevator car 1, namely a car body 2 and a car frame 3. The car body 2 and the car frame 3 are connected by means of elastomeric springs 4.1 to 4.6 forming a so-termed car insulation 4. This reduces the transmission of solid-borne sound from the frame to the car body. For modeling a rigid elevator car 1 it is sufficient to consider the car body and the car frame overall as one body.

The transverse stiffness of the car body 2 and the car frame 3 is substantially less than the stiffness in the vertical direction. This can be modeled by division in each instance into at least two rigid bodies, namely car bodies 2.1 and 2.2 and car frames 3.1 and 3.2. The at least two part bodies are horizontally coupled by springs 5, 6.1 and 6.2 and can be regarded as rigidly connected in the vertical direction.

A plurality of guide rollers 7.1 to 7.8 together with the proportional masses of levers and actuators can be modeled by at least eight rigid bodies or also disregarded. This dependent on the associated natural frequencies of the guide rollers and on the upper limit of the frequency range which is considered. Since the natural frequency of the actuator/roller system can lead to instability in the regulated state, modeling by rigid bodies is preferred. These are displaceable relative to the frame only perpendicularly to the support surface at the rail and are coupled with roller guide springs 8.1 to 8.8. In the other directions they are rigidly connected with the frame.

Figure 2:
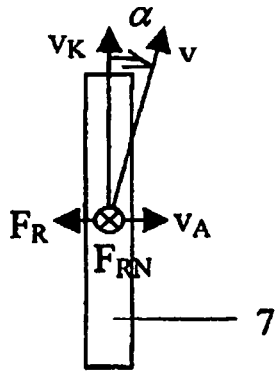
FIG. 2 is a schematic elevation view of a guide roller with roller forces.

As is shown in FIG. 2, the guide behavior or the force coupling between a guide roller 7 and a guide rail is important. Substantially only two horizontal force components are necessary for formation of the model. The vertical force components, which result from the rolling resistance, can be disregarded. The normal force results from the elastic compression of roller coverings 9.1 to 9.8 (FIG. 1) on the guide rollers 7.1 to 7.8 respectively. The axial or transverse force results from the angle between the straight lines perpendicular to the roller axis and parallel to the rail and the actual direction of movement of the roller centre point.

Mathematically, the following relationships are relevant:

$$F_{RA}=-\tan(\alpha)*F_{RN}*K$$

$F_{RA}$: rolling force in axial direction in [N]

A: oblique running angle in [rad]

$F_{RN}$: rolling force normal to the support surface [N]

K: constant without dimension, determined by measuring

The force law set forth in equation {1} above is at the latest invalid when the limits of the static friction force are reached as well as in the case of a large value of the oblique running angle α. This is rapidly greater at low travel speed and at standstill amounts to approximately 90 degrees. The force law {1} thus applies only to the moving car.

For the rolling force in an axial direction with the car moving, there then approximately applies:

$$F_{RA}=-v_A/v_K*F_{RN}*K$$

$$F_{RA}=-v_A*(F_{RN}*K/v_K)$$

$v_K$: vertical speed of the car [m/s]

$v_A$: speed of the car in axial direction [m/s]

K is a constant and $v_K$ and $F_{RN}$ canx be regarded as constant when the biasing force is significantly greater than the dynamic proportion of the normal force. This means that the rolling force in the axial direction is proportional and opposite to the speed in the axial direction and conversely proportional to the travel speed of the elevator car.

Transverse vibrations of the car are thus damped by the rollers like a viscous damper, wherein the effect is smaller with increasing travel speed.

Figure 3:
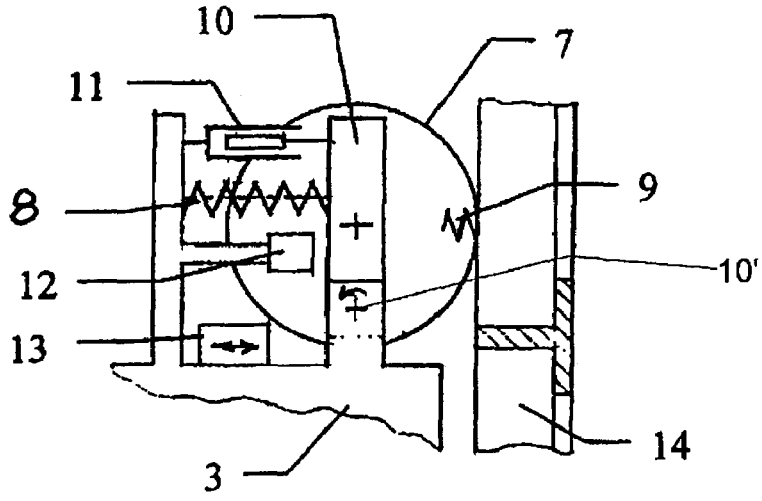
FIG. 3 is schematic elevation view of a setting element with the guide roller of FIG. 2, an actuator and sensors.

As shown in FIG. 3, the guide roller 7 is connected with the car frame 3 by a lever 10 rotatable about an axis 10', wherein a roller guide spring 8 produces a force between the lever and the car frame. An actuator 11 produces a force acting parallel to the roller guide spring 8. A position sensor 12 measures the position of the lever 10 or of the guide roller 7. An acceleration sensor 13 measures the acceleration of the elevator car frame 3 perpendicularly to the support surface of a roller covering 9 on a guide rail 14. The reference numerals of the respective elements 7 through 9 apply as shown in FIG. 1 (for example, at the elevator car 1 at the bottom on the right: 7.1, 8.1, 9.1).

The four lower guide rollers 7.1 to 7.4 together with actuators and position sensors are provided at the elevator car 1. In addition, the four upper guide rollers 7.5 to 7.8 together with actuators and position sensors can also be provided. The number of acceleration sensors 13 required corresponds with the number of regulated axes, wherein at least three and at most six acceleration sensors are provided.

Figure 4:
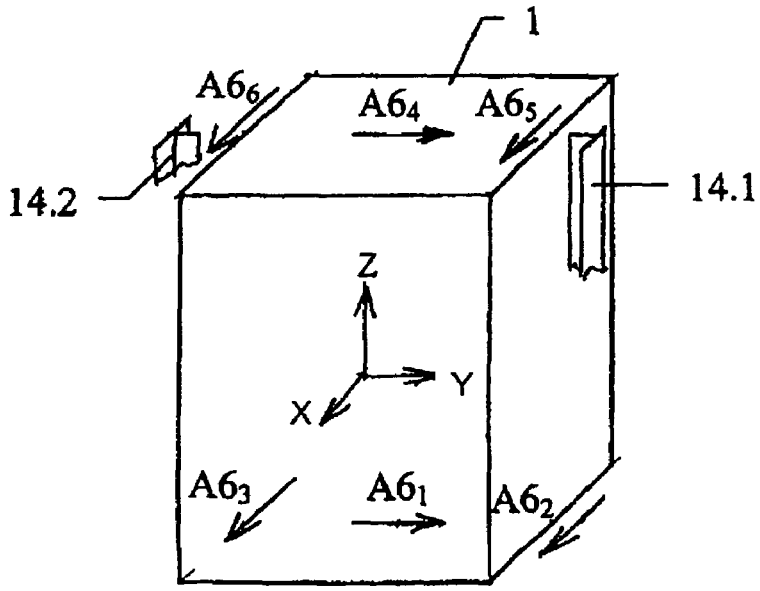
FIG. 4 is a schematic illustration of the regulated axes.

As shown in FIG. 4, for the active vibration damping of the elevator car 1 the number of axes is reduced from eight to six, or four to three axes when active regulation is only at the bottom. A triplet of signals $Fn_i$, $Pn_i$, $an_i$ for actuator force, position and acceleration belongs to each axis $An_i$. The index "I" is the continuing numbering in the respective axial system and "n" stand for the number of axes of the system.

The signals of the lower and the upper roller pair between guide rails 14.1 and 14.2 are combined as follows: a force signal $F6_1$ for actuators 11.1 and 11.3 or a force signal $F6_4$ for actuators 11.5 and 11.7 is divided into a positive and negative half. Each actuator is controlled in drive only by one half and can produce only a compressive force in the roller covering. A mean value is formed from the signals of position sensors 12.1 and 12.3 and the same applies to position sensors 12.5 and 12.7. A mean value is similarly formed from the signals of acceleration sensors 13.1 and 13.3 or 13.5 and 13.7. Since the acceleration sensors 13.1 and 13.3 or 13.5 and 13.7 lie on one axis and are rigidly connected by the lower or upper car frame, they in principle measure the same and in each instance one sensor of the respected pair can be omitted.

Figure 11:
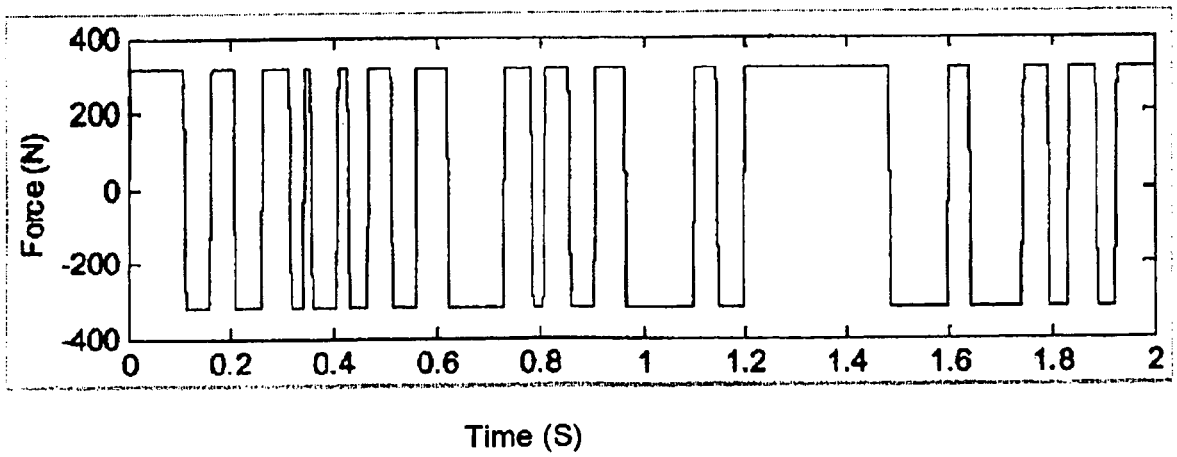
FIG. 11 is a plot of a force signal for excitation of the actuators.

In the case of measuring travels, one or more actuators is or are controlled in drive by a force signal as shown in FIG. 11 and the elevator car one is so excited to vibrations transversely to the travel direction that clearly measurable signals arise in the position sensors 12 and in the acceleration sensors 13. So that the correlation of the measurements with the force signals can be reliably determined, usually only one actuator pair is controlled in drive. As shown in Table 1 at least as many measuring travels are necessary as active axes are provided.

TABLE 1

| Excitation: one or more simultaneously | Measurements: all simultaneously | |
|---|---|---|
| $F6_1$ | $P6_1$ | $a6_1$ |
| $F6_2$ | $P6_2$ | $a6_2$ |
| $F6_3$ | $P6_3$ | $a6_3$ |
| $F6_4$ | $P6_4$ | $a6_4$ |
| $F6_5$ | $P6_5$ | $a6_5$ |
| $F6_6$ | $P6_6$ | $a6_6$ |

The frequency spectrum of the force signals as well as the measured position signals and acceleration signals are determined by Fourier transformation. The transfer functions in the frequency range or frequency responses $G_{i,j}(\omega)$ at the angular frequency ω as argument are determined in that the spectra of the measurements are divided by the associated spectrum of the force signal. In that case i is the index of the measurement and j is the index of the force.

$$G^P_{i,j}(\omega) = \frac{P_i(\omega)}{F_j(\omega)}$$

$$G^a_{i,j}(\omega) = \frac{a_i(\omega)}{F_j(\omega)}$$

$$G(\omega) = \begin{bmatrix} G^P(\omega) \\ G^a(\omega) \end{bmatrix}$$

$G^P_{i,j}(\omega)$ are the individual frequency responses of force to position and $G^a_{i,j}(\omega)$ are the individual frequency responses of force to acceleration. The matrix $G^P(\omega)$ contains all frequency responses of force to position and matrix $G^a(\omega)$ all frequency responses of force to acceleration. The matrix $G(\omega)$ arises from the vertical combination of $G^P(\omega)$ and $G^a(\omega)$.

For a 6-axis system there thus results 2×6×6=72 transfer functions and for a 3-axis system 2×3×3=18 transfer functions. In the case of cars having a center of gravity lying on the axis between the guide rails 14.1 and 14.2 the couplings and the correlation between the two horizontal directions "x" and "y" are weak. For that reason only approximately half the transfer functions are further used, the remaining being excluded due to inadequate correlation.

The MBS model of the car is in general a linear system. If this contains non-linear components, a fully linearized model is produced in an appropriate operational state by numerical differentiation. In the linear state space the MBS model is described by the following equations:

$$\dot{x}=Ax+Bu$$

$$y=Cx+Du$$

x is the vector of the states of the system, which in general are not externally visible. The states of the system in the present case are:

positions and speeds of the center of gravity in the solid body model, as well as rotational angles and rotational speeds. Derivations of the states are speeds and accelerations. Speed is thus both state and derivation.

The vector $\dot{x}$ contains the derivations of x according to time. y is a vector which contains the measured magnitudes, thus positions and accelerations. The vector u contains the inputs (actuator forces) of the system. A, B, C and D and are matrices which together form the so-termed Jacobi matrix by which a linear system is completely described. The frequency response of the system is given by $$G^{\wedge}(\omega)=D+C(j\omega I-A)^{-}B.$$

$G^{\wedge}(\omega)$ is a matrix with the same number of lines as measurements in the vector y and the same number of columns as inputs in the vector u and contains all frequency responses of the MBS model of the car.

A Jacobi matrix contains all partial derivations of a system of equations. In the case of a linear system of coupled differential equations of 1st order, these are the constant coefficients of the A, B, C and D matrices.

The model contains a number of well-known parameters such as, for example, measurements and masses and a number of poorly known parameters such as, for example, spring rates and damping constants. It is necessary to identify these poorly known parameters. The identification is carried out in that the frequency responses of the model are compared with the measured frequency responses. The poorly known model parameters are changed by an optimization algorithm until the minimum of the sum e of all deviations of the frequency responses of the model is found by the measured frequency responses.

$$e_{i,j}(\omega) = \frac{|G^{\wedge}_{i,j}(\omega)| - |G_{i,j}(\omega)|}{\sqrt{|G_{i,j}(\omega)|}} \cdot w(\omega)$$

$$e = \sum_i \sum_j \sum_\omega [e_{i,j}(\omega)]^2$$

$w(\omega)$ is a weighting dependent on frequency. It ensures that only important components of the measured frequency responses are simulated in the model.

An optimization algorithm can be briefly circumscribed as follows: A function with several variables is given. A minimum or maximum of this function is sought. An optimization algorithm seeks those extremes. There are many various algorithms, for example the method of fastest degression seeks the greatest gradients with the help of the partial derivations and rapidly finds local minima, but for that purpose can pass over others. Optimization is a mathematical procedure used in many fields of expertise and an important area of scientific investigation.

Figure 5:
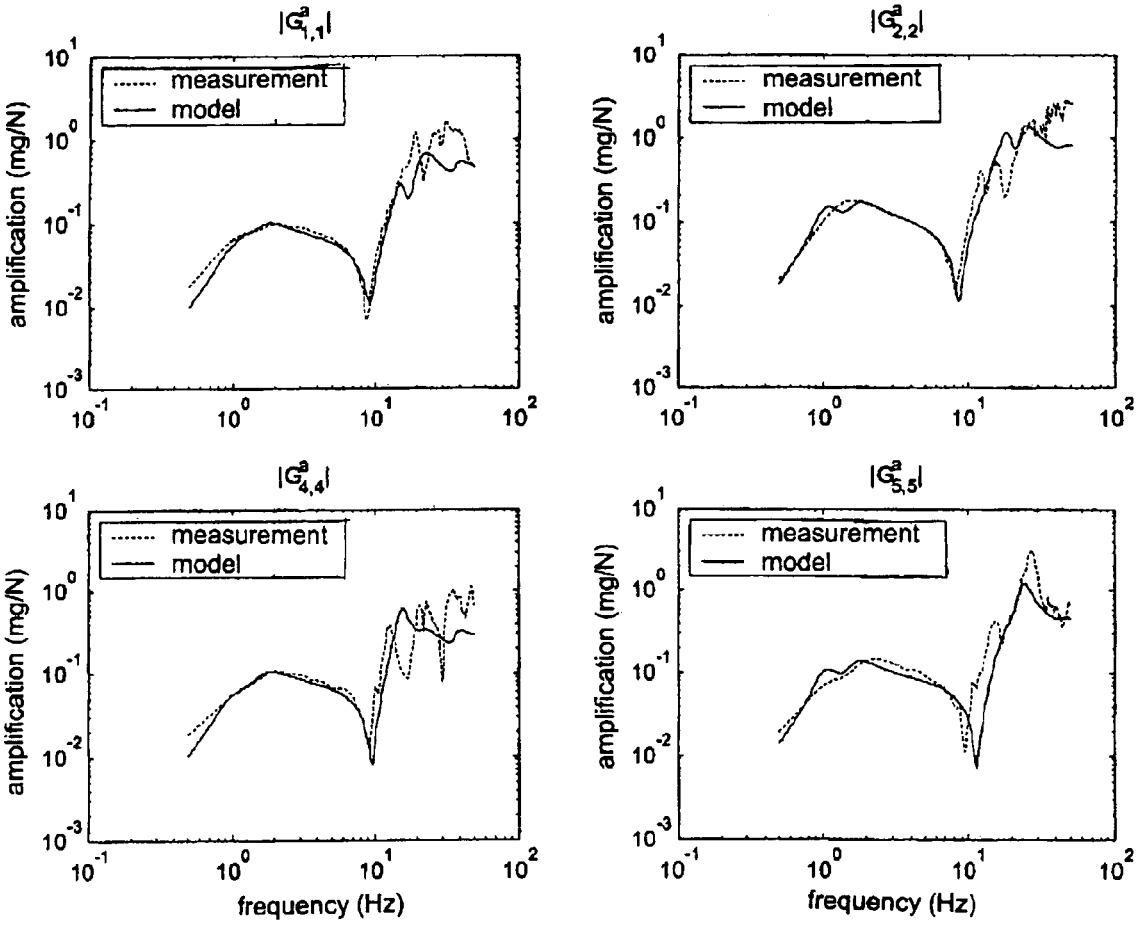
FIG. 5 shows plots of amplification of the acceleration versus frequency for measured acceleration of the car and acceleration of the identified model.

FIG. 5 shows the frequency-dependent amplifications of the acceleration measured and of the identified model. $|Ga_{1,1}|$ means amount or amplitude of the transfer function or of the frequency response of force to acceleration with the output acceleration from axis 1 and with the input force from axis 1. Dimension: 1 mg/N=1 milli-g/N=0.0981 m/s^2/N~1 cm/s $\hat{0}$2/N.

FIG. 11 shows the force signal for excitation of the actuators 11. The excitation is carried out by a so-termed random binary signal, which is produced by means of a random generator, wherein the amplitude of the signal can be fixedly set, for example to ±300 N, and the spectrum is widely and uniformly distributed.

The model with the identified parameters forms the basis for the design of an optimum regulator for active vibration damping. Regulator structure and regulator parameters are dependent on the characteristics of the path to be regulated, in this case on the elevator car. The elevator car has a static and dynamic behavior which is described in the model. Important parameters are: masses and mass inertia moments, geometries such as, for example, height(s), width(s), depth(s), track size, etc., spring rates and damping values. If the parameters change, then that has influence on the behavior of the elevator car and thus on the settings of the regulator for vibration damping. In the case of a classic PID regulator (Proportional, Integral and Differential regulator) three amplifications have to be set, which can be readily managed manually. The regulator for the present case has far above a hundred parameters, whereby a manual sitting in practice is no longer possible. The parameters accordingly have to be automatically ascertained. This is possible only with the help of a model which describes the essential characteristics of the elevator car.

Figure 6:
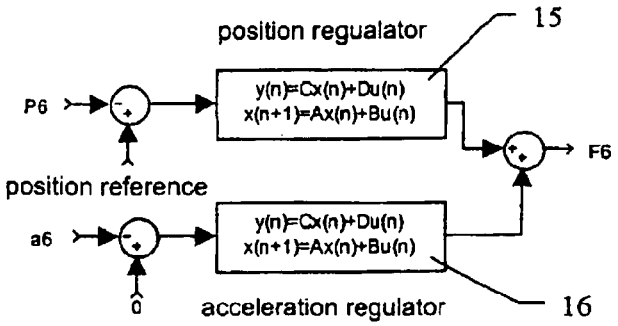
FIGS. 6 and 7 are schematic circuit diagrams of an optimized regulator with the identified parameters for active vibration damping according to the present invention.
Figure 7:
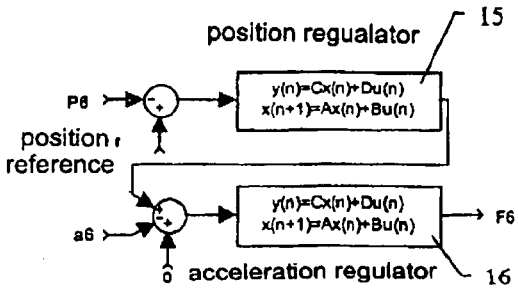

The regulation shown in FIG. 6 is divided into two regulators connected in parallel:

A position regulator 15 and an acceleration regulator 16. Other structures of the regulation are also possible, particularly a cascade connection of position regulator and acceleration regulator as shown in FIG. 7. The regulators are linear, time-invariant, time-discrete and they regulate several axes simultaneously, hence the designation MIMO for Multi-Input, Multi-Output. "n" is the continuing index of the time step in a time-discrete or "digital" regulator.

The updated states x(n+1) for the next time step are calculated so that they are available there.

A dynamic system is time-invariant when the described parameters remain constant. A linear regulator is time-invariant when the system matrices A, B, C and D do not change. Regulators realized on a digital computer are always also time-discrete. This means they make inputs, calculations and outputs at fixed intervals in time.

Figure 8:
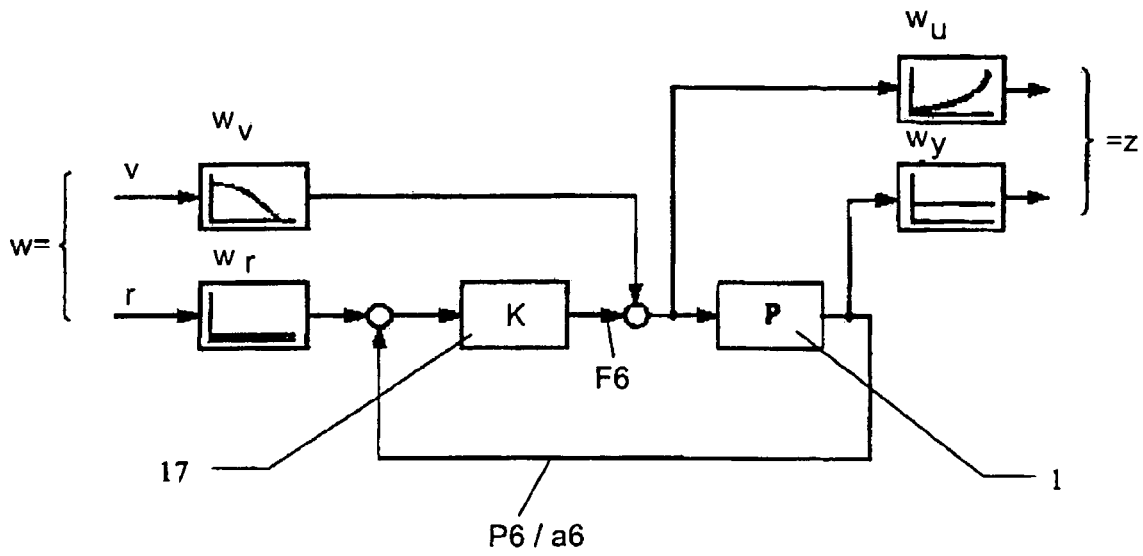
FIG. 8 is a signal flow chart for the design of an $H_\infty$ regulator and regulator path.

The so-termed $H_\infty$ method is used for the regulator design. FIG. 8 shows the signal flow chart of the $H_\infty$ design method with closed regulating loop. The main advantage of the $H_\infty$ design method is that it can be automated. In that case the $H_\infty$ standard of the system to be regulated is minimized by closed regulating loop. The $H_\infty$ of a matrix A with m×n elements is given by:

$$\|A\|_\infty = \max_i \sum_{j=1}^{n} |a_{i,j}| \quad \text{(maximum 'lines sum')}$$

The system to be regulated is the identified model of the elevator car 1 with the designation P for plant as shown in FIG. 8. The desired behavior of the regulator K with the reference numeral 17 is produced with the help of additional weighting functions at the input and output of the system.

$w_v$ models the interferences in the frequency range at the input of the system $w_r$ is a small constant value $w_u$ limits the regulator output $w_y$ has the value one FIG. 8 is a diagram for the design of the regulator by the $H_\infty$ method. "w" is the vector signal at the input and is composed of "v" and "r". "z" is the vector signal at the output, wherein z=T*w. T is composed of regulator, regulating path and weighting functions. P6 or a6 forms the feedback in the closed regulating loop, in the case of separate design of position regulator or of acceleration regulator. F6 is the output or the setting signal of the regulator. The $H_\infty$ standard is minimized by $\|z\|H_\infty/\|w\|H_\infty=\|T\|H_\infty$. For that purpose there is again necessary an optimization algorithm which changes the parameters of the regulator until a minimum has been found.

Figure 9:
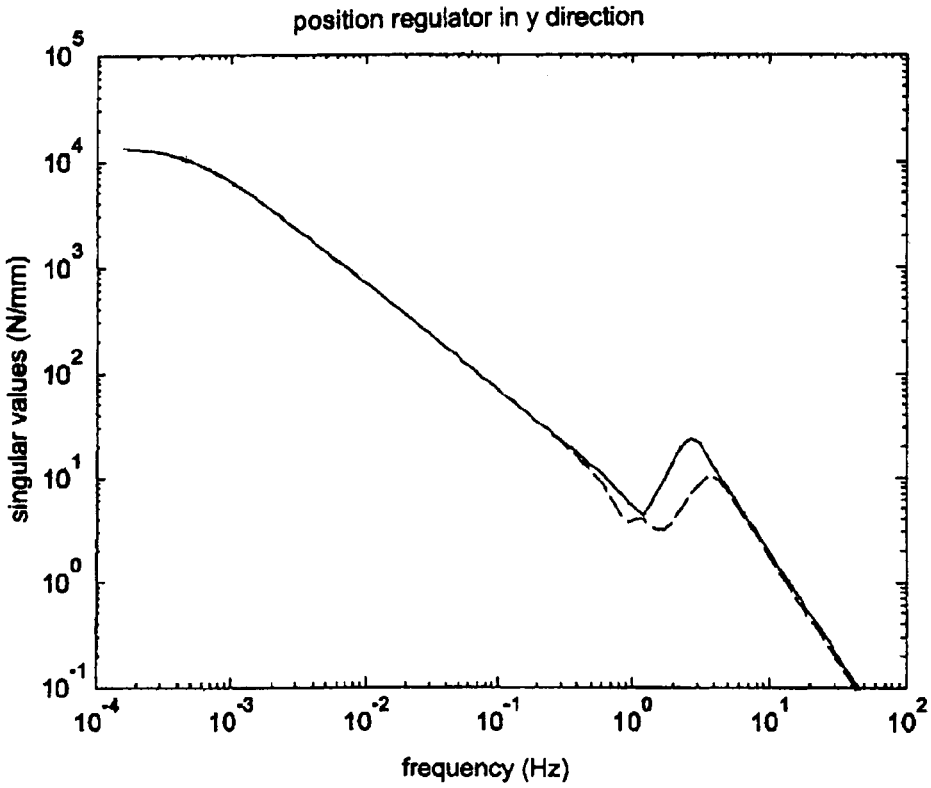
FIG. 9 is a plot of the singular values of a position regulator in the "y" direction.

FIG. 9 shows the course of the singular values of a position regulator in the "y" direction. This has predominantly an integrating behavior.

Figure 10:
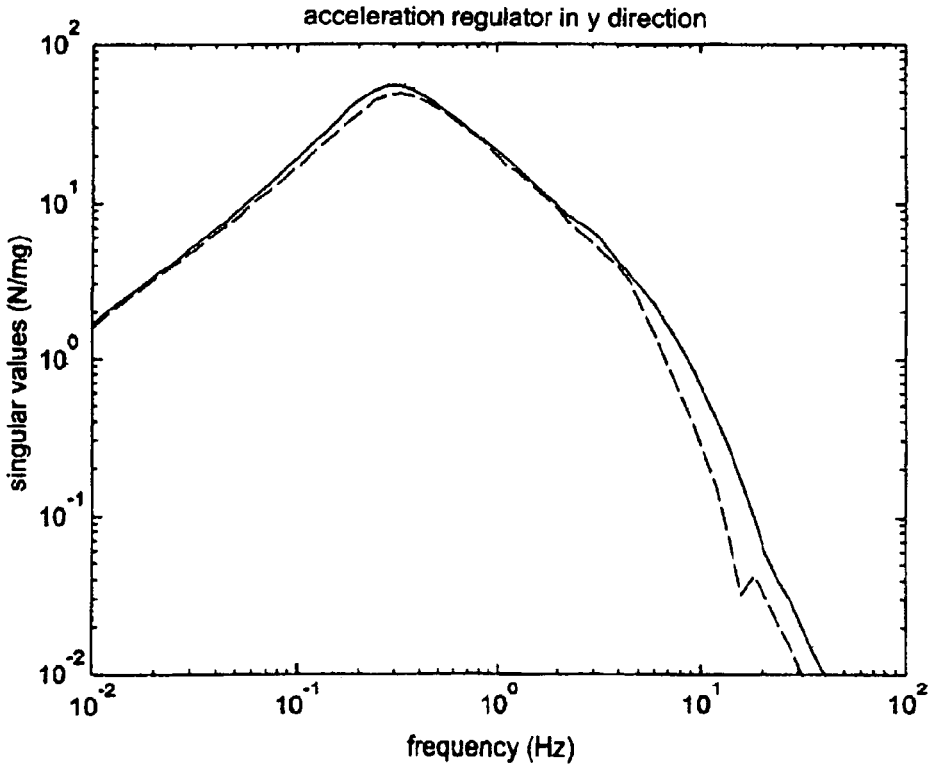
FIG. 10 is a plot of the singular values of an acceleration regulator in the "y" direction.

FIG. 10 shows the course of the singular values of an acceleration regulator in the "y" direction. This has a bandpass characteristic.

Singular values are a measure for the overall amplification of a matrix. An n×n matrix has "n" singular values. Dimension: 1 N/mg=1 N/milli-g=N/(0.0981 m/s^2) ~1 N/(cm/s^2).

In accordance with the provisions of the patent statutes, the present invention has been described in what is considered to represent its preferred embodiment. However, it should be noted that the invention can be practiced otherwise than as specifically illustrated and described without departing from its spirit and scope.

What is claimed is:

1. A method for vibration damping at an elevator car using a regulator, wherein a regulator design is based on a model of the elevator car, comprising the steps of:

a. determining an overall model of the elevator car with model parameters which are at least one of known and estimated;

b. identifying the parameters for the elevator car by comparison of at least one of transfer functions and frequency responses of the model with respective measured transfer functions and measured frequency responses;

c. changing the model parameters in order to achieve a greatest possible correspondence with the measured frequency responses;

d. designing an optimum regulator for active vibration damping of the elevator car, wherein the model together with the identified parameters serves as a basis for the design; and e. providing the elevator car with an active damping system as the regulator having the optimum regulator design, the active damping system including actuators for exciting the elevator car and measuring the frequency responses for use in step b.

2. The method according to claim 1 including exciting the elevator car with the actuators and measuring the frequency responses with one of acceleration sensors and position sensors.

3. The method according to claim 1 including changing the model parameters with an optimization algorithm until a minimum of the sum (e) of all deviations of the frequency responses of the model from the measured frequency responses is found.

4. The method according to claim 3 wherein the deviations between the frequency responses of the model and the measured frequency responses are weighted by a frequency dependent value w(ω) in the calculation of the sum (e).

5. The method according to claim 1 including performing said step d. using an $H_\infty$ method.

6. The method according to claim 5 wherein the regulator includes a position regulator which controls actuators in dependence on a position of the elevator car, the actuators moving guide elements on the elevator car to adopt a predetermined position, and the regulator includes an acceleration regulator which controls the actuators in drive in dependence on an acceleration of the elevator car, whereby vibrations occurring at the elevator car are suppressed.

7. The method according to claim 6 including connecting the position regulator and the acceleration regulator in parallel, wherein setting signals of the position regulator and the acceleration regulator are added and supplied to the actuators as a summation signal.

8. The method according to claim 6 including connecting the position regulator and the acceleration regulator in series, wherein a setting signal of the position regulator is fed to the acceleration regulator as an input signal.

9. The method according to claim 6 wherein the position regulator and the acceleration regulator are effective substantially in different frequency ranges.

10. The method according to claim 1 including performing said step a. utilizing a multi-body system (MBS) model for an elastic elevator car having at least two bodies describing a car body as well as a car frame.

11. The method according to claim 1 including performing said step a. utilizing a model for a rigid elevator car having a car body and a car frame overall as one body.

12. A method for vibration damping at an elevator car using a regulator, wherein the regulator design is based on a model of the elevator car, comprising the steps of:

a. determining an overall model of the elevator car with model parameters which are at least one of known and estimated;

b. identifying the parameters for the elevator car by comparison of at least one of transfer functions and frequency responses of the model with respective measured transfer functions and measured frequency responses;

c. changing the model parameters in order to achieve a greatest possible correspondence with the measured frequency responses;

d. designing an optimum regulator for active vibration damping of the elevator car, wherein the model together with the identified parameters serves as a basis for the design;

e. providing the elevator car with an active damping system as the regulator having the optimum regulator design, the active damping system including actuators for exciting the elevator car; and f. exciting the elevator car with the actuators and measuring the frequency responses with one of acceleration sensors and position sensors for use in step b.

* * * * *